US008342988B1

(12) United States Patent
Becnel

(10) Patent No.: US 8,342,988 B1
(45) Date of Patent: Jan. 1, 2013

(54) WEIGHT ATTACHABLE TO A RACQUET

(76) Inventor: Mark C. Becnel, Destin, FL (US)

( * ) Notice: Subject to any disclaimer, the term of this patent is extended or adjusted under 35 U.S.C. 154(b) by 239 days.

(21) Appl. No.: 12/925,756

(22) Filed: Oct. 29, 2010

(51) Int. Cl.
*A63B 69/00* (2006.01)
*A63B 49/04* (2006.01)

(52) U.S. Cl. ..... 473/437; 473/422; 473/519

(58) Field of Classification Search ..... 473/437, 473/422, 457, 519, 554, 256; D21/755
See application file for complete search history.

(56) References Cited

U.S. PATENT DOCUMENTS

| | | | | | |
|---|---|---|---|---|---|
| 1,180,290 | A | * | 4/1916 | Goldberger | 473/554 |
| 1,437,378 | A | * | 11/1922 | Westcott Holmes | 473/554 |
| 1,500,054 | A | * | 7/1924 | Coltman | 473/554 |
| 1,549,114 | A | * | 8/1925 | Hampden | 473/554 |
| 1,841,596 | A | * | 1/1932 | Halpin | D21/755 |
| 1,914,086 | A | * | 6/1933 | Gates | 473/554 |
| 2,109,799 | A | * | 3/1938 | Moore | 473/531 |
| 2,196,625 | A | * | 4/1940 | Clowson | 473/554 |
| 2,628,804 | A | * | 2/1953 | Goodman | 473/554 |
| 2,801,105 | A | * | 7/1957 | Acton | 211/86.01 |
| 2,818,257 | A | * | 12/1957 | Allen | 473/554 |
| 3,330,560 | A | | 7/1967 | Higdon | |
| 3,414,260 | A | | 12/1968 | Gust | |
| 3,642,283 | A | | 2/1972 | Wilkens | |
| 3,913,911 | A | | 10/1975 | Peterson | |
| 4,000,893 | A | | 1/1977 | Evans | |
| 4,005,864 | A | | 2/1977 | Stewart | |
| 4,007,930 | A | * | 2/1977 | Straus | 206/315.9 |
| 4,052,061 | A | | 10/1977 | Stewart | |
| 4,108,433 | A | | 8/1978 | Althoff | |
| 4,200,285 | A | | 4/1980 | Petitti, Jr. | |
| 4,249,728 | A | | 2/1981 | Bratt | |
| 4,538,812 | A | | 9/1985 | Mugford et al. | |
| 4,598,891 | A | * | 7/1986 | Hanert | 248/340 |
| 4,671,510 | A | | 6/1987 | Schoenwetter | |
| 4,697,811 | A | | 10/1987 | Muroi | |
| 4,861,029 | A | * | 8/1989 | Takatsuka | 473/540 |
| 5,083,777 | A | | 1/1992 | Held | |
| 5,186,699 | A | | 2/1993 | Dimmig | |
| 5,286,021 | A | | 2/1994 | Shaw | |
| 5,944,622 | A | | 8/1999 | Buck et al. | |
| 5,964,671 | A | | 10/1999 | Edwards et al. | |
| D501,037 | S | | 1/2005 | Okamoto | |

* cited by examiner

*Primary Examiner* — Mitra Aryanpour
(74) *Attorney, Agent, or Firm* — Peter Loffler

(57) ABSTRACT

A weight member is removably attachable to a racquet for use during warm-up. The device is a skeletal structure that has a laterally expandable mouth, a throat, and a pair of heads that resiliently converge toward one another. The skeletal structure is formed of a metal bar member of a gauge to match the desired device weight and is coated with a protective outer layer. At least one resilient member can bridge a gap at the mouth and throat. The device is symmetrical in both the X-plane and the Y-plane.

16 Claims, 6 Drawing Sheets

WEIGHT ATTACHABLE TO A RACQUET

BACKGROUND OF THE INVENTION

1. Field of the Invention

The present invention relates to a weighted structure that is removably attachable to a racquet, such as a tennis racquet, so that a player is able to use the racquet, with the present invention attached, during pre-practice and pre-game warm-up.

2. Background of the Prior Art

Tennis is a sport enjoyed by countless numbers of players all across the country. Although tennis is considered a relatively active and high paced sport, both younger as well as older players hit the tennis courts with passion and zeal. Like other athletic endeavors, tennis players understand the importance of warming up prior to a practice or a game. Warming up allows the players muscles to become warmed up and stretched which helps increase the player's on court performance and helps minimize the potential for injury or muscle pull, especially in light of the fact that tennis is considered a high impact sport.

In addition to a regiment of some standard basic muscle stretches, many tennis players will perform various tennis swings with the tennis racquet at reduced speed in order to mimic the moves that will be placed upon the person's body during the practice session or game, thereby targeting the specific muscle groups to be used at the specific angles involved in the game. Players often place weights onto the tennis racquet in order to more fully pre-stress the muscles being challenged.

One method to add weight to the tennis racquet during warm-up is to use a warm-up specific racquet that is designed to weigh more than a typical tennis racquet. The purpose of such a racquet is strictly for warm-up purposes and is not designed for game play. While effective, such racquet are burdensome in that they must be carried by the player in addition to the player's other racquet or racquets and otherwise take up an inordinate amount of space.

Another method to add weight to the racquet is by attaching a weight member to the racquet, typically either proximate the sweet spot of the strings or to the racquet frame at the tip of the frame or where the throat of the racquet meets the head. While reasonably effective, such weight member additions are not without their problems. Weight members that are attached to the strings can cause the strings to stretch, especially if the weight member is fairly heavy and/or the player is aggressive during warm-up. Additionally, such weights tend to be relatively cumbersome to attach to and remove from the racquet. Furthermore, due to the placement of the weight at one area of the racquet, the weight concentrates the weight thereat and leaves the racquet fairly unbalanced so as to give less than ideal warm-up system.

What is needed is a device that attaches to a game usable tennis racquet in order to provide additional weight to the racquet for warm-up purposes, which device overcomes the above mentioned shortcoming currently found in the art. Such a weight device needs to be easy to attach to and remove from the racquet without fear of causing damage to the racquet either during install or during use. Such a device must spread its mass over a large area of the racquet head so as to give the user a more natural and balanced feel during warm-up sessions using the device. Ideally, such a device should be relatively simple in design and construction so as to be readily affordable to potential consumers of such devices

SUMMARY OF THE INVENTION

The weight attachable to a racquet of the present invention addresses the aforementioned needs in the art by providing a weight member that attaches to a racquet, such as a tennis racquet, in order to allow a player to have a weighted warm-up session using his or her game racquet. The weight attachable to a racquet is quick and easy to attach to and remove from the racquet and spreads its mass over substantially all of the racquet head so as to allow the racquet to be balanced during warm-up. The weight attachable to a racquet does not increase the potential of damage to the racquet during device usage. The weight attachable to a racquet is of relatively simple design and construction making the device relatively easy to produce so that the device is readily affordable to potential consumers for such devices.

The weight attachable to a racquet is comprised of a skeletal member that has a mouth with a gap. The mouth has a pair of upper lips and a pair of opposing lower lips. An upper throat member leads from the upper lips proximate the gap while an upper head leads from the upper throat member with the upper head having an upper bar. A lower throat member leads from the lower lips proximate the gap while a lower head leads from the lower throat member. The lower head has a lower bar. The mouth is laterally expandable. The upper head and the lower head converge toward one another and are radially separable from one another. The skeletal member is formed from a bar member, which may be a continuous member so as to be of unitary construction and may be of monolithic construction, that is made from a desired metal and that has resiliency. The skeletal member is symmetrical in the X-plane and in the Y-plane. The bar member has an outer layer formed from a non-abrasive material such as rubber, Neoprene, plastic, etc. At least one resilient member may be attached to the upper throat member and spans the gap. A first rise is located centrally along the upper bar while a second rise is centrally located along the lower bar. The racquet heads fits within the skeletal member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
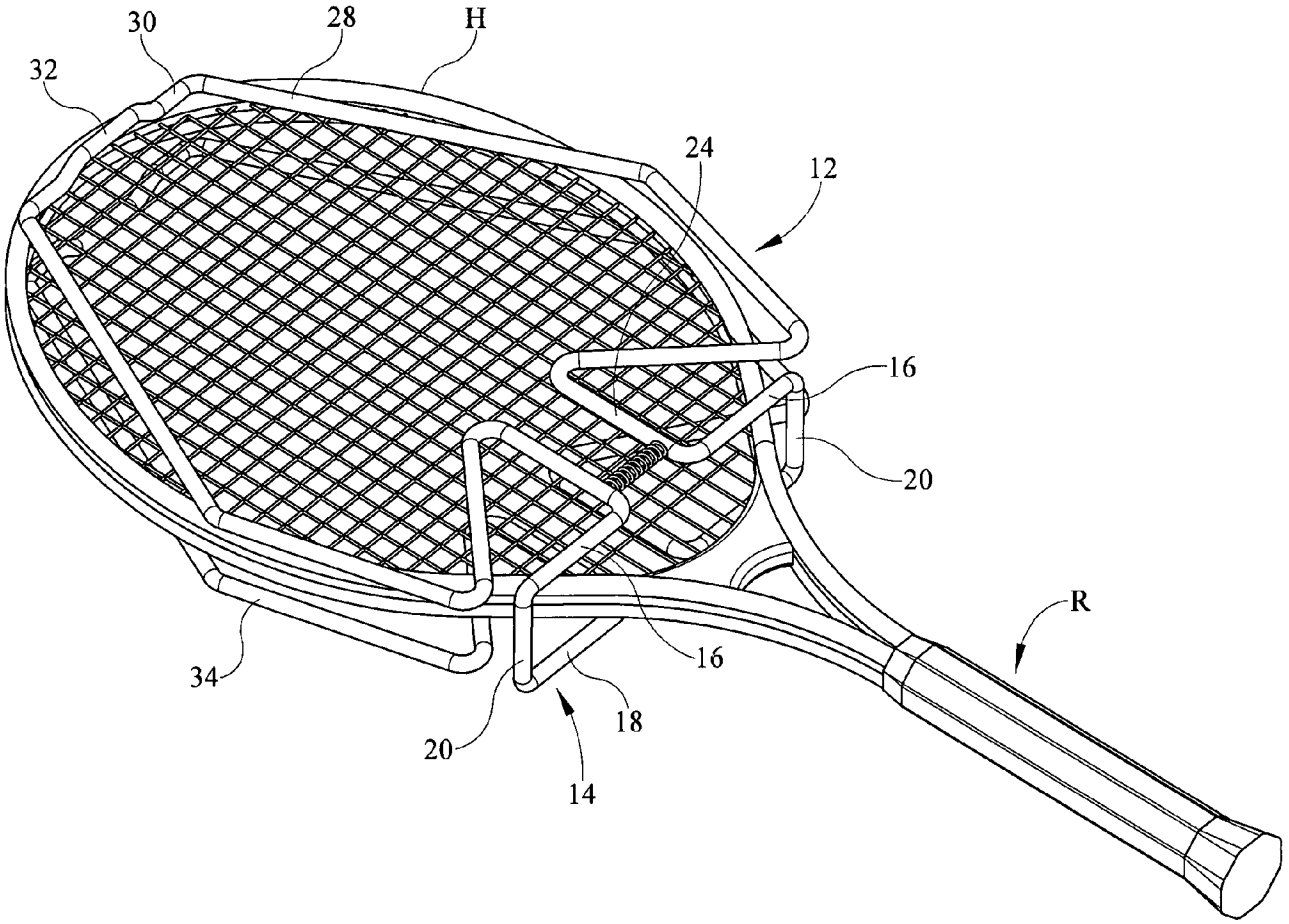
FIG. 1 is a perspective view of the weight attachable to a racquet of the present invention attached to a racquet.
Figure 2:
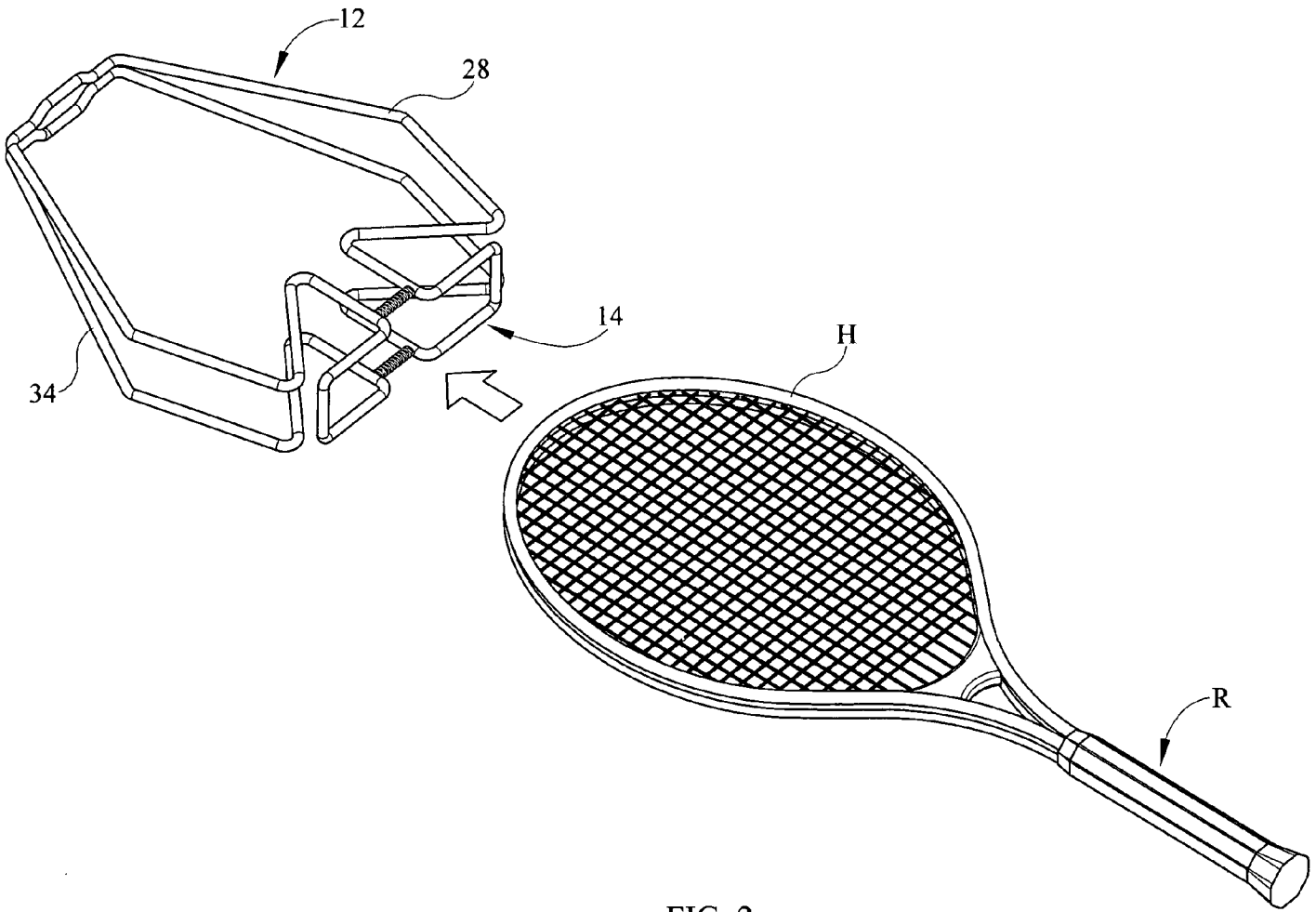
FIG. 2 is a perspective view illustrating the attachment process for attaching the weight attachable to a racquet to the racquet.

Referring now to the drawings, it is seen that the weight attachable to a racquet of the present invention, generally denoted by reference numeral 10, is comprised of a skeletal structure 12 that has a mouth 14 with a pair of upper lips 16 and a pair of lower lips 18 each opposing upper lip 16 lower lip 18 pair being joined by a connector 20. As seen, the mouth 14 has a gap 22 between the upper lip 16 pairs and the lower lip 18 pairs. The mouth 14 is laterally expandable so that the gap 22 can increase in size. Extending upwardly from the distal end (the end opposite the connector 20 bearing end) of each upper lip 16 is an upper throat member 24 while a lower throat member 26 extends upwardly from the distal ends of each lower lip 18. The two upper throat members 24 and the two lower throat members 26 are all coextensive with one another and define an overall throat. Extending from the top end of each upper throat member 24 is an upper head 28 that has a upper bar 30 which upper bar 30 has a rise 32 centrally located therealong. Extending from the top end of each lower throat member 26 is a lower head 34 that has a lower bar 36 which lower bar 36 also has a rise 38 centrally located therealong rising in a direction opposite the rise 32 of the upper bar 30. The upper head 28 and the lower head 34 are coextensive with one another so that the skeleton structure is substantially symmetrical in both the X-plane and the Y-plane. The upper head 28 and the lower head 34 are shaped to essentially follow the outline of a head H of a racquet R. As seen, the upper head 28 and the lower head 34 angle and converge toward one another so that the upper bar 30 and the lower bar 36 essentially touch one another.

Figures 3, 6:
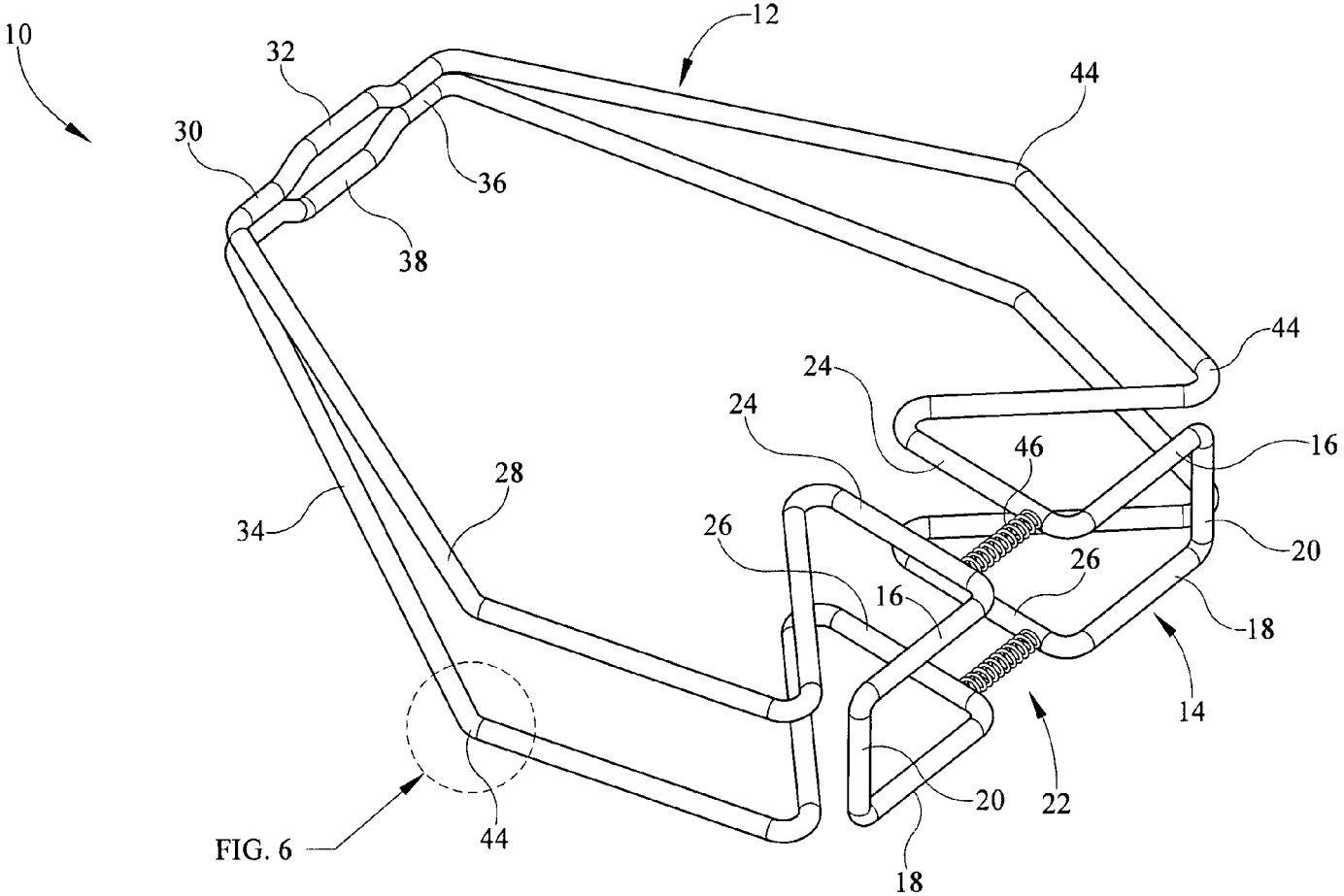
FIG. 3 is a perspective view of the weight attachable to a racquet.
FIG. 6 is a close-up detail view from FIG. 3.
Figure 4:
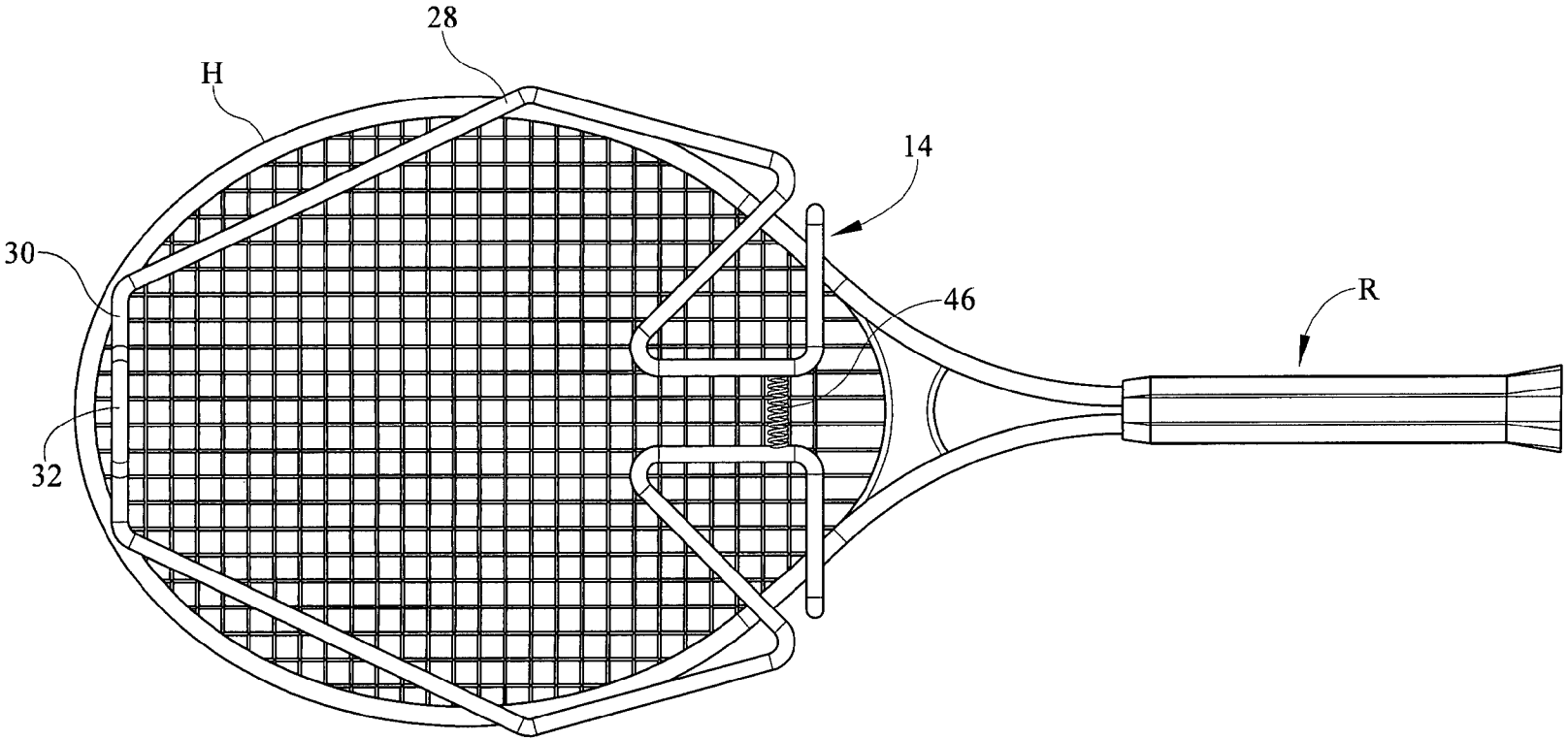
FIG. 4 is a plan view of the weight attachable to a racquet attached to the racquet.
Figure 5:
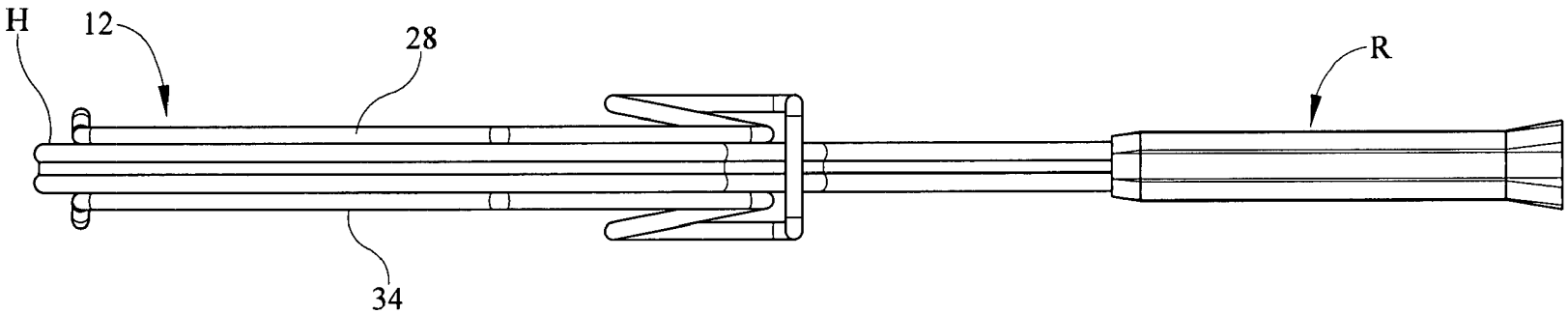
FIG. 5 is a side view of the weight attachable to a racquet attached to the racquet.
Figure 6:
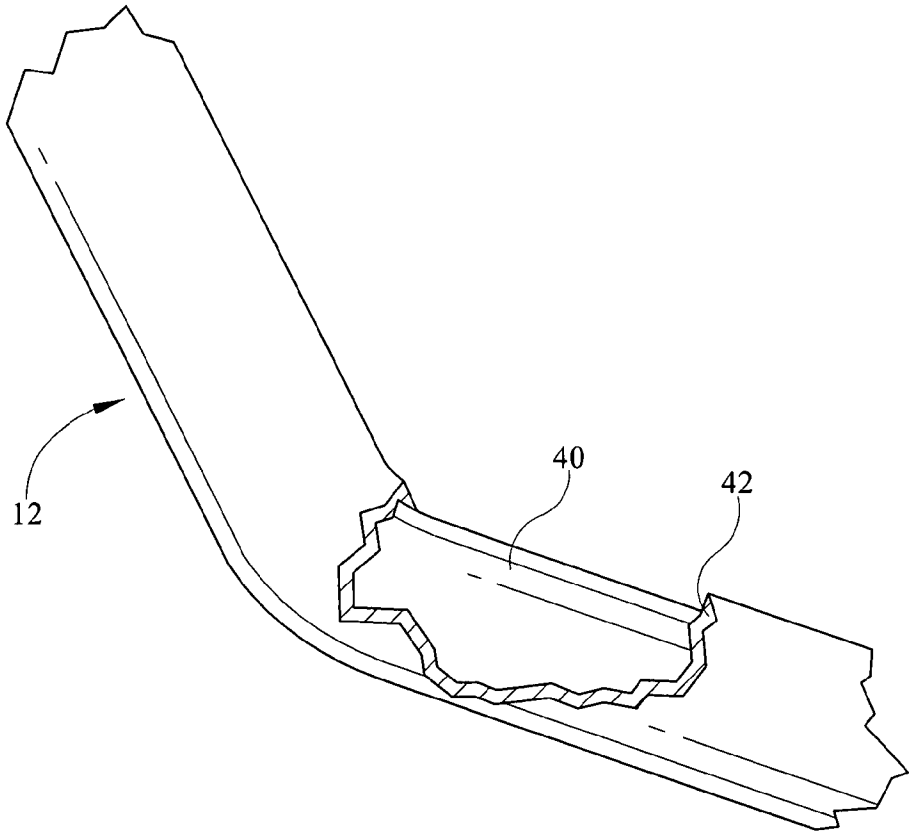

As seen in FIG. 6, the skeletal structure 12 is formed of an inner bar member 40 that is made from a metal, the gauge of the bar member 40 being dependent on the desired weight of the overall device 10 (as well as the specific metal being used). The entire skeletal structure 12 can be made from a single continuous length of bar member 40 that is bent into the appropriate shape with the two ends of the bar member 40 possibly, but not necessarily, spot welded together (spot welding not illustrated). The outer surface of the bar member 40 is surrounded by an appropriate non-abrasive protective layer 42, such as rubber, neoprene, plastic etc., in order to protect the racquet R used with the device 10. The gaps 44 in the protective layer 42 are present for ease of manufacture of the device 10 and to allow appropriate expansion and contraction of the skeletal structure 12, essentially acting as expansion joints.

The bar member 40 has a certain amount of resiliency so that, as noted earlier, the mouth 14 is laterally expandable. If desired, one or more optional resilient members 46, such as the illustrated springs (rubber bands, bungee cord, etc.,), can span the gap 22 and be connected to the upper throat members 24 and/or to the lower throat members 26. Additionally, the upper head 28 and the lower head 34 are radially separable from one another.

In order to use the weight attachable to a racquet 10 of the present invention, the head H of the racquet R is inserted into the device 10 through the mouth 14. The mouth 14 is laterally expanded in order to allow the head H to pass therethrough. The racquet R continues to be inserted until the tip of the head H of the racquet R is at or just beyond the upper bar 30 and the lower bar 36. The upper head 28 and the lower head 34 are radially separated from one another in order to accommodate the head H of the racquet R passing therethrough. The racquet R is now fully received within the device 10. The resilient nature of the bar member 40 causes the upper head 28 and the lower head 34 to contract back toward one another and thereby bias against the head H of the racquet R in order to secure the device 10 against the racquet R. Additionally, the mouth 14 laterally contracts back toward its original position, under the assistance of the resilient members 46, if used, in order to provide additional grip of device 10 onto racquet R. The user is now free to use the racquet R for warm-up exercises as desired. In order to remove the weight attachable to a racquet 10 from the racquet R, the racquet R is removed from the skeletal structure 12 in reverse direction from the direction of insertion. In order to assist such removal, the upper head 28 and the lower head 34 are resiliently gapped a little further away from one another in order to release the grip on the head H of the racquet R. The rise 32 in the upper bar 30 and the rise 38 in the lower bar 36 assist the user in getting a firm grip on the upper head 28 and lower head 34 respectively to accomplish the radial separation. Once the racquet R is fully removed from the device 10, the upper head 28 and the lower head 34 resiliently bias back toward one another while the mouth resiliently gaps back toward its initial state.

While the invention has been particularly shown and described with reference to an embodiment thereof, it will be appreciated by those skilled in the art that various changes in form and detail may be made without departing from the spirit and scope of the invention.

I claim:

1. A weight attachable to a racquet, the weight comprising a skeletal member that has a mouth with a gap, the mouth having a pair of upper lips and a pair of lower lips, an upper throat member leading from the upper lips proximate the gap and an upper head leading from the upper throat member, the upper head having an upper bar, a lower throat member leading from the lower lips proximate the gap and a lower head leading from the lower throat member, the lower head having a lower bar such that the mouth is laterally expandable, the upper head and the lower head resiliently converge toward one another and are radially separable from one another, and the skeletal member is formed from a bar member that is made from a metal and has resiliency.

2. The weight as in claim 1 wherein the bar member has an outer layer formed from a non-abrasive material.

3. The weight as in claim 1 further comprising a resilient member attached to the upper throat member and spanning the gap.

4. The weight as in claim 2 further comprising a resilient member attached to the upper throat member and spanning the gap.

5. The weight as in claim 1 further comprising:
a first rise located centrally along the upper bar; and
a second rise centrally located along the lower bar.

6. The weight as in claim 2 further comprising:
a first rise located centrally along the upper bar; and
a second rise centrally located along the lower bar.

7. The weight as in claim 3 further comprising:
a first rise located centrally along the upper bar; and
a second rise centrally located along the lower bar.

8. The weight as in claim 4 further comprising:
a first rise located centrally along the upper bar; and
a second rise centrally located along the lower bar.

9. A weight attachable to a racquet, the weight comprising a skeletal member that has a mouth with a gap, the mouth having a pair of upper lips and a pair of lower lips, an upper throat member leading from the upper lips proximate the gap and an upper head leading from the upper throat member, the upper head having an upper bar, a lower throat member leading from the lower lips proximate the gap and a lower head leading from the lower throat member, the lower head having a lower bar such that the mouth is laterally expandable, the upper head and the lower head resiliently converge toward one another and are radially separable from one another, the skeletal member is formed from a bar member that is made from a metal and has resiliency, and the skeletal member is symmetrical in the X-plane and in the Y-plane.

10. The weight as in claim 9 wherein the bar member has an outer layer formed from a non-abrasive material.

11. The weight as in claim 9 further comprising a resilient member attached to the upper throat member and spanning the gap.

12. The weight as in claim 10 further comprising a resilient member attached to the upper throat member and spanning the gap.

13. The weight as in claim 9 further comprising:
a first rise located centrally along the upper bar; and
a second rise centrally located along the lower bar.

14. The weight as in claim 10 further comprising:
a first rise located centrally along the upper bar; and
a second rise centrally located along the lower bar.

15. The weight as in claim 11 further comprising:
a first rise located centrally along the upper bar; and
a second rise centrally located along the lower bar.

16. The weight as in claim 12 further comprising:
a first rise located centrally along the upper bar; and
a second rise centrally located along the lower bar.

* * * * *